US009743785B2

(12) United States Patent
Crawford

(10) Patent No.: US 9,743,785 B2
(45) Date of Patent: Aug. 29, 2017

(54) WALL-MOUNTING BRACE FOR MIRRORS, ARTWORK, AND SIMILAR OBJECTS

(71) Applicant: Christopher Lee Crawford, Otsego, MA (US)

(72) Inventor: Christopher Lee Crawford, Otsego, MA (US)

( * ) Notice: Subject to any disclaimer, the term of this patent is extended or adjusted under 35 U.S.C. 154(b) by 0 days.

(21) Appl. No.: 15/012,565

(22) Filed: Feb. 1, 2016

(65) Prior Publication Data

US 2016/0360904 A1 Dec. 15, 2016

Related U.S. Application Data

(60) Provisional application No. 62/174,594, filed on Jun. 12, 2015.

(51) Int. Cl.

| | |
|---|---|
| ***A47G 1/16*** | (2006.01) |
| ***E06B 9/00*** | (2006.01) |
| ***A47G 1/06*** | (2006.01) |
| ***A47G 1/21*** | (2006.01) |
| *E06B 9/02* | (2006.01) |

(52) U.S. Cl.

CPC ..... *A47G 1/1606* (2013.01); *A47G 1/0633* (2013.01); *A47G 1/16* (2013.01); *A47G 1/1613* (2013.01); *A47G 1/215* (2013.01); *E06B 9/00* (2013.01); *E06B 9/02* (2013.01); *E06B 2009/005* (2013.01)

(58) Field of Classification Search

CPC ..... A47G 1/16; A47G 1/1606; A47G 1/1613; A47G 1/215; E06B 9/00; E06B 2009/005; E06B 9/02

USPC ..... 248/466, 475.1, 484, 485, 476, 480, 488

See application file for complete search history.

(56) References Cited

U.S. PATENT DOCUMENTS

| | | | | | |
|---|---|---|---|---|---|
| 2,204,862 | A | * | 6/1940 | Lehman | A47G 1/215 248/466 |
| 3,478,997 | A | * | 11/1969 | Goss | A47G 1/215 248/201 |
| 4,669,209 | A | * | 6/1987 | Pollack | A47G 1/0605 40/757 |
| 4,685,261 | A | * | 8/1987 | Seaquist | E06B 9/02 49/463 |
| 5,295,651 | A | * | 3/1994 | Baker, Jr. | A47G 1/215 248/488 |
| 5,347,775 | A | * | 9/1994 | Santos | E06B 9/00 49/460 |

(Continued)

FOREIGN PATENT DOCUMENTS

| | | | |
|---|---|---|---|
| DE | 39911336 | * | 1/1991 |

*Primary Examiner* — Eret McNichols

(57) ABSTRACT

A wall-mounting brace for mirrors, artwork, and similar objects is a device that is utilized to secure an object such as a mirror to a surface such as a wall. The device features an elongated brace that is used to hold the top of the mirror to the wall while the bottom of the mirror is held in place with a fastener such as a J-channel. A plurality of fastener holes present on a mounting plate of the elongated brace is utilized to secure the elongated brace to the surface. The mirror is held in place on the surface by a retention plate and a connector plate of the elongated brace. A cover plate is utilized to selectively cover and uncover the plurality of fastener holes. The cover plate may be hingedly attached to the elongated brace or removable from the elongated brace altogether.

15 Claims, 14 Drawing Sheets

(56) References Cited

U.S. PATENT DOCUMENTS

| | | | | | |
|---|---|---|---|---|---|
| 5,430,982 | A * | 7/1995 | Bane | E06B 9/04 | 49/464 |
| 5,768,833 | A * | 6/1998 | Golen | E06B 9/02 | 248/488 |
| 6,269,597 | B1 * | 8/2001 | Haas | E06B 9/02 | 49/464 |
| 7,677,521 | B2 * | 3/2010 | Price | A47G 1/1613 | 248/475.1 |
| 8,371,543 | B2 * | 2/2013 | Schneider | F16M 13/02 | 248/224.8 |
| 8,708,302 | B2 * | 4/2014 | Wilder | B42D 5/046 | 248/452 |
| 2005/0115124 | A1 * | 6/2005 | Murray | A47G 1/0633 | 40/746 |
| 2007/0199181 | A1 * | 8/2007 | Eichert | A47G 1/10 | 16/404 |
| 2008/0098664 | A1 * | 5/2008 | McGregor | A47B 95/04 | 52/38 |
| 2008/0308702 | A1 * | 12/2008 | Beyer, Jr. | B42D 5/005 | 248/475.1 |
| 2012/0180413 | A1 * | 7/2012 | Halischuk | E04F 13/21 | 52/288.1 |
| 2015/0157146 | A1 * | 6/2015 | Deloache | A47G 1/06 | 40/700 |

* cited by examiner

WALL-MOUNTING BRACE FOR MIRRORS, ARTWORK, AND SIMILAR OBJECTS

The current application claims a priority to the U.S. Provisional Patent application Ser. No. 62/174,594 filed on Jun. 12, 2015.

FIELD OF THE INVENTION

The present invention relates generally to an apparatus for mounting a mirror or similar object to a wall or other flat surface. More specifically, the present invention is a wall-mounting brace for mirrors, artwork, and similar objects.

BACKGROUND OF THE INVENTION

A common method of installing a mirror to a wall or similar surface involves the use of J-channels that are fastened to a flat surface in order to hold the mirror in place. In order to ensure proper installation, a J-channel for the lower edge of the mirror must be measured and fastened to the wall. The mirror is then seated into the lower J-channel and the location of the mirror's top edge is marked on the wall. The mirror is then removed from the lower J-channel and an upper J-channel is installed onto the wall at the appropriate position. Constant movement of the mirror during the installation process increases the likelihood of damage to the mirror as well as to the person performing the installation. Additionally, the difficulty of the installation process may require more than one person to be involved. Because of the precision required to install a mirror utilizing J-channels, the process can be quite difficult and tedious. An alternative to J-channels is to utilize clips or similar fasteners to attach the top of a mirror to a wall. This eliminates the need to move the mirror during installation, but the exposed clips may be aesthetically unpleasing. Additionally, because multiple fasteners must be attached to the top of the mirror in order to ensure that the mirror is securely in place, this process can be quite tedious as well.

The present invention is a wall-mounting brace for mirrors, artwork, and similar objects. The present invention facilitates the installation as well as the removal of a mirror from a wall or similar flat surface. Additionally, the present invention is aesthetically pleasing as no fasteners are exposed to view after the mirror is installed. The fasteners may be temporarily uncovered in order to gain access to the fasteners and then covered to hide the fasteners from view.

DETAIL DESCRIPTIONS OF THE INVENTION

All illustrations of the drawings are for the purpose of describing selected versions of the present invention and are not intended to limit the scope of the present invention.

Figure 1:
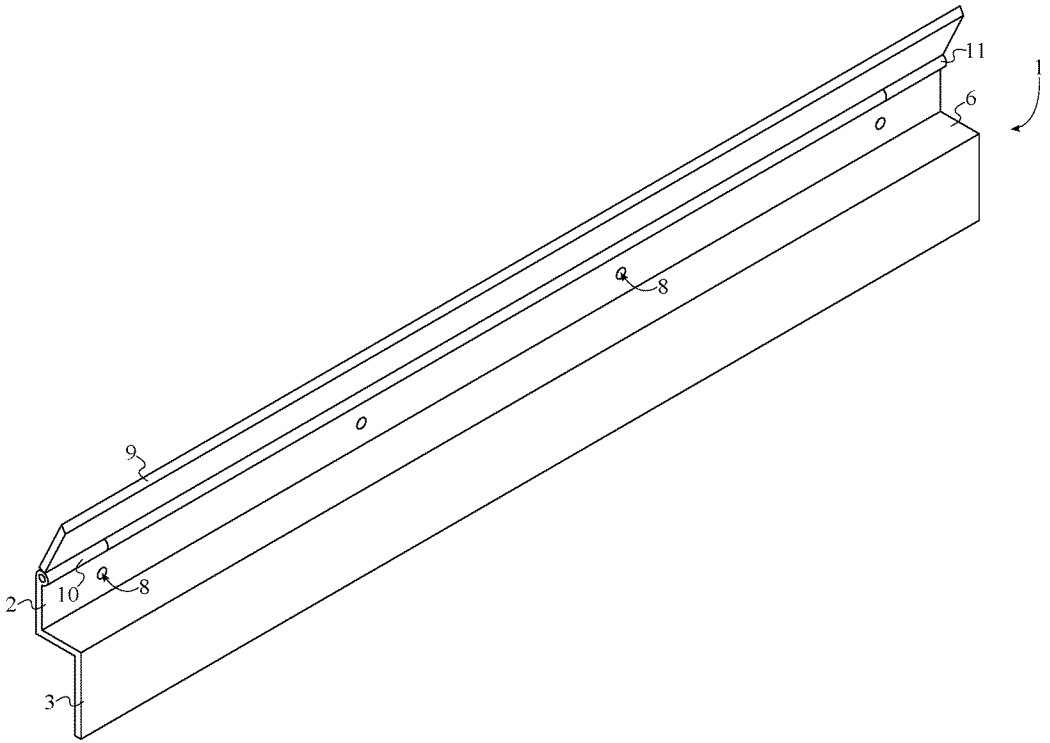
FIG. 1 is a perspective view of the present invention.

The present invention is a wall-mounting brace for mirrors, artwork, and similar objects. The present invention greatly simplifies the process of installing objects to a surface and additionally provides an aesthetically pleasing appearance when installed. While the present invention may be utilized to secure a variety of objects to a surface, the present invention is herein described with respect to the mounting of a mirror to a surface such as a wall. The present invention is shown in FIG. 1 and FIG. 2 and comprises an elongated brace 1, a plurality of fastener holes 8, and a cover plate 9.

Figure 3:
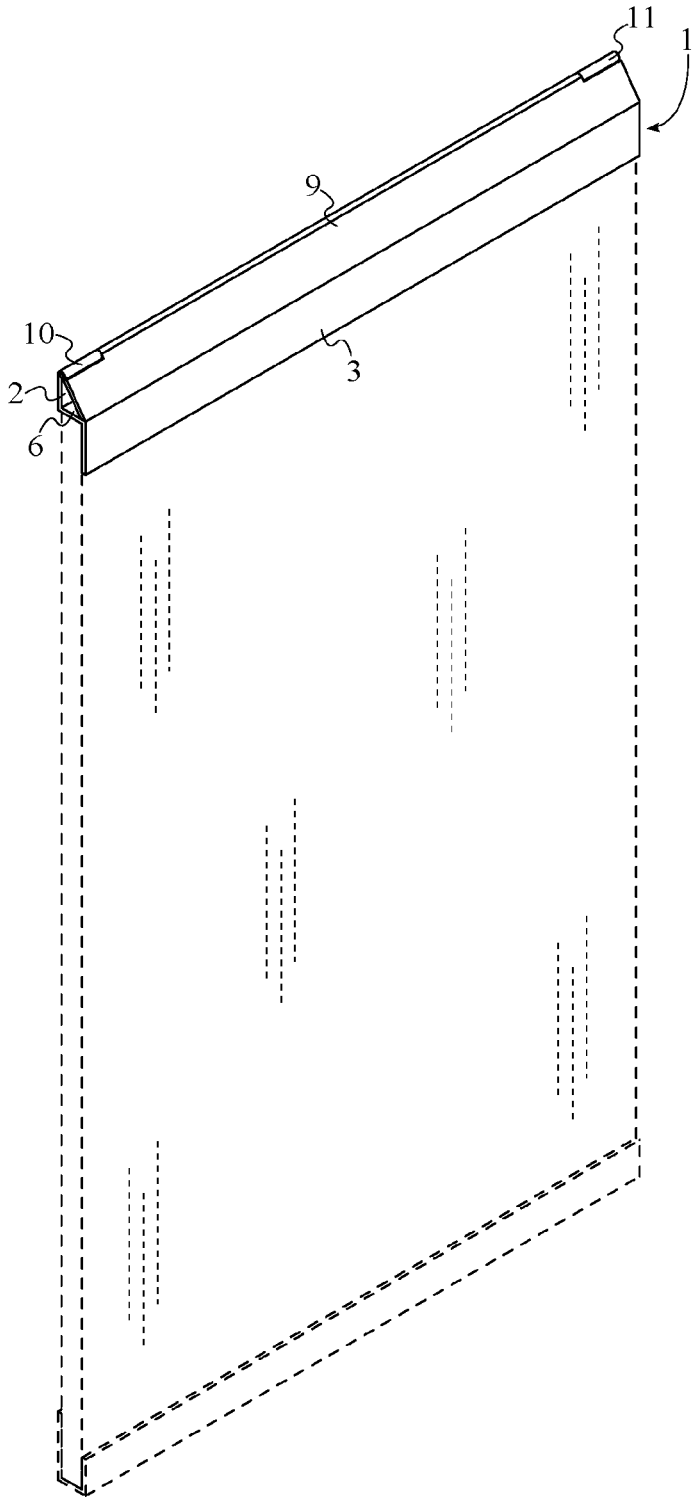
FIG. 3 is a perspective view of the present invention in use with a mirror and a J-channel.
Figure 4:
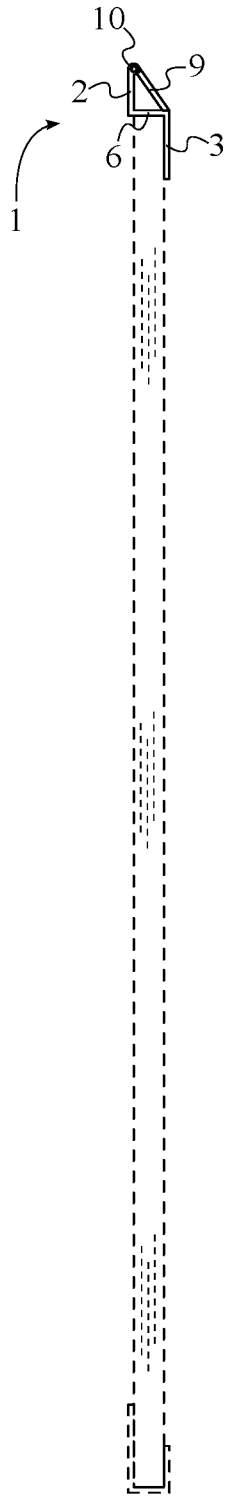
FIG. 4 is a side view of the present invention in use with a mirror and a J-channel.

The elongated brace 1 is utilized to secure the mirror in place on the surface and is preferably sufficiently sized to hold the entire width of the mirror. During typical use of the present invention, a conventional fastener such as, but not limited to, a J-channel is utilized to hold the bottom end of the mirror in place on a wall or similar surface as shown in FIG. 3 and FIG. 4. The bottom end of the mirror is seated into the J-channel and secured in place while the present invention is utilized to secure the top end to the surface. The elongated brace 1 holds the top end of the mirror in place and prevents the mirror from tipping forward when seated within the J-channel. The elongated brace 1 is preferably composed of a material that is not damaging to the mirror when the mirror is mounted in place on the surface with the elongated brace 1. The elongated brace 1 eliminates the need for any additional measurements to be made after the bottom end of the mirror has been installed into the J-channel. Again with reference to FIG. 1 and FIG. 2, the elongated brace 1 comprises a mounting plate 2, a retention plate 3, and a connector plate 6. The mounting plate 2 is the portion of the elongated brace 1 that is fastened to the surface while the retention plate 3 holds the mirror in place and prevents the mirror from moving once installed. The mounting plate 2 is joined to the retention plate 3 via the connector plate 6. The mounting plate 2 and the retention plate 3 each comprise a proximal edge 4 and a distal edge 5. The proximal edge 4 is the edge of the mounting plate 2 and the retention plate 3 that is positioned toward the connector plate 6 while the distal edge 5 is the edge of the mounting plate 2 and the retention plate 3 that is oriented away from the connector plate 6.

The connector plate 6 is connected adjacent and along the proximal edge 4 of the mounting plate 2 and is connected adjacent and along the proximal edge 4 of the retention plate 3 as well. In the preferred embodiment of the present invention, the mounting plate 2, the retention plate 3, and the connector plate 6 are of the same length for secure placement of the mirror on the surface. The mounting plate 2 and the retention plate 3 are oriented parallel to each other, thus enabling the mirror to be held against the surface. In the preferred embodiment of the present invention, the mounting plate 2 and the retention plate 3 are positioned opposite to each other across the connector plate 6. Additionally, the distal edge 5 of the mounting plate 2 and the distal edge 5 of the retention plate 3 are oriented in opposite directions from the connector plate 6. The mounting plate 2, the retention plate 3, and the connector plate 6 are thus positioned with respect to each other as shown in FIG. 2. The top edge of the mirror is held in place against the connector plate 6 while the top portion of the front surface of the mirror is held in place against the retention plate 3.

Figure 2:
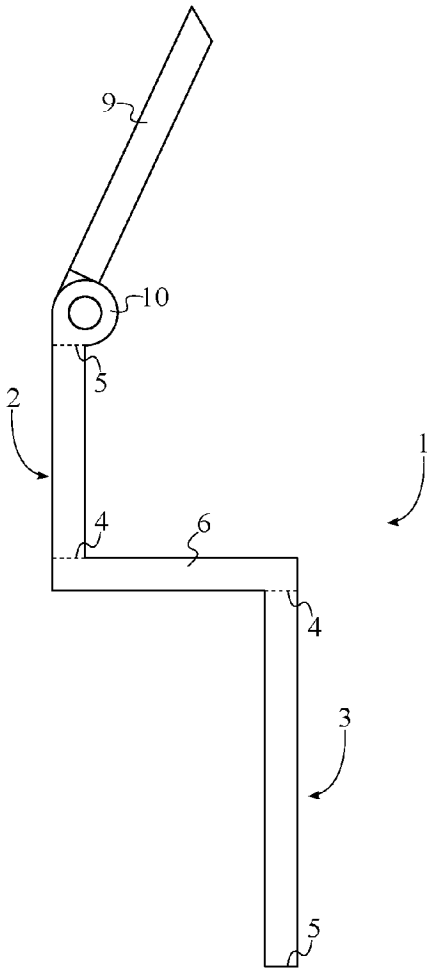
FIG. 2 is a side view of the present invention.

With continued reference to FIG. 2, in the preferred embodiment of the present invention, the proximal edge 4 of the mounting plate 2 is perpendicularly connected to the connector plate 6. Similarly, the proximal edge 4 of the retention plate 3 is perpendicularly connected to the connector plate 6, opposite to the mounting plate 2. The retention plate 3 and the connector plate 6 are thus positioned in a manner such that the mirror may be held in place by the retention plate 3 and the connector plate 6. The mounting plate 2 is positioned in a manner such that the elongated brace 1 may be secured to the surface while the mirror is held in place by the retention plate 3 and the connector plate 6.

Again with reference to FIG. 1, the plurality of fastener holes 8 enables fasteners such as screws to be utilized to secure the elongated brace 1 to the surface. The plurality of fastener holes 8 is evenly distributed across the mounting plate 2. Fasteners are thus spaced in a manner such that the elongated brace 1 is securely fastened to the surface at multiple positions along the length of the mounting plate 2. The plurality of fastener holes 8 traverses through the mounting plate 2, allowing fasteners to be inserted through the mounting plate 2 and into the surface. The present invention is not limited with respect to the specific number of the plurality of fastener holes 8 and the number of the plurality of fastener holes 8 may vary for larger or smaller mirrors.

Figure 5:
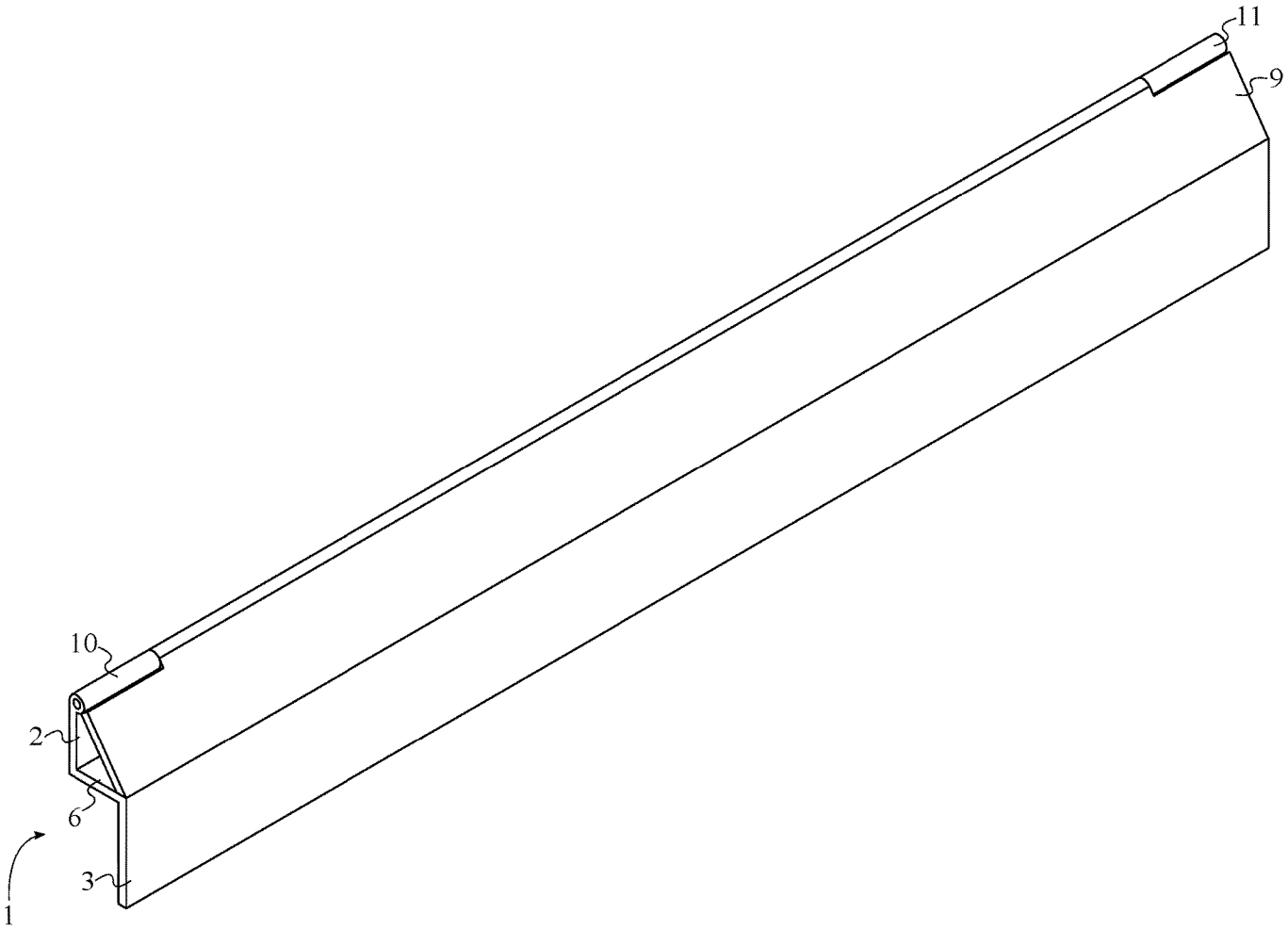
FIG. 5 is a perspective view of the present invention with the cover plate covering the plurality of fastener holes from view.
Figure 6:
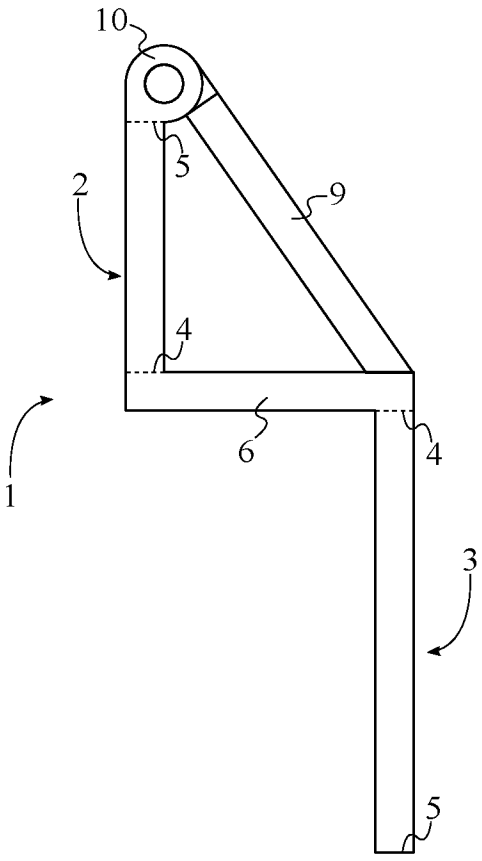
FIG. 6 is a side view of the present invention with the cover plate covering the plurality of fastener holes from view.
Figure 7:
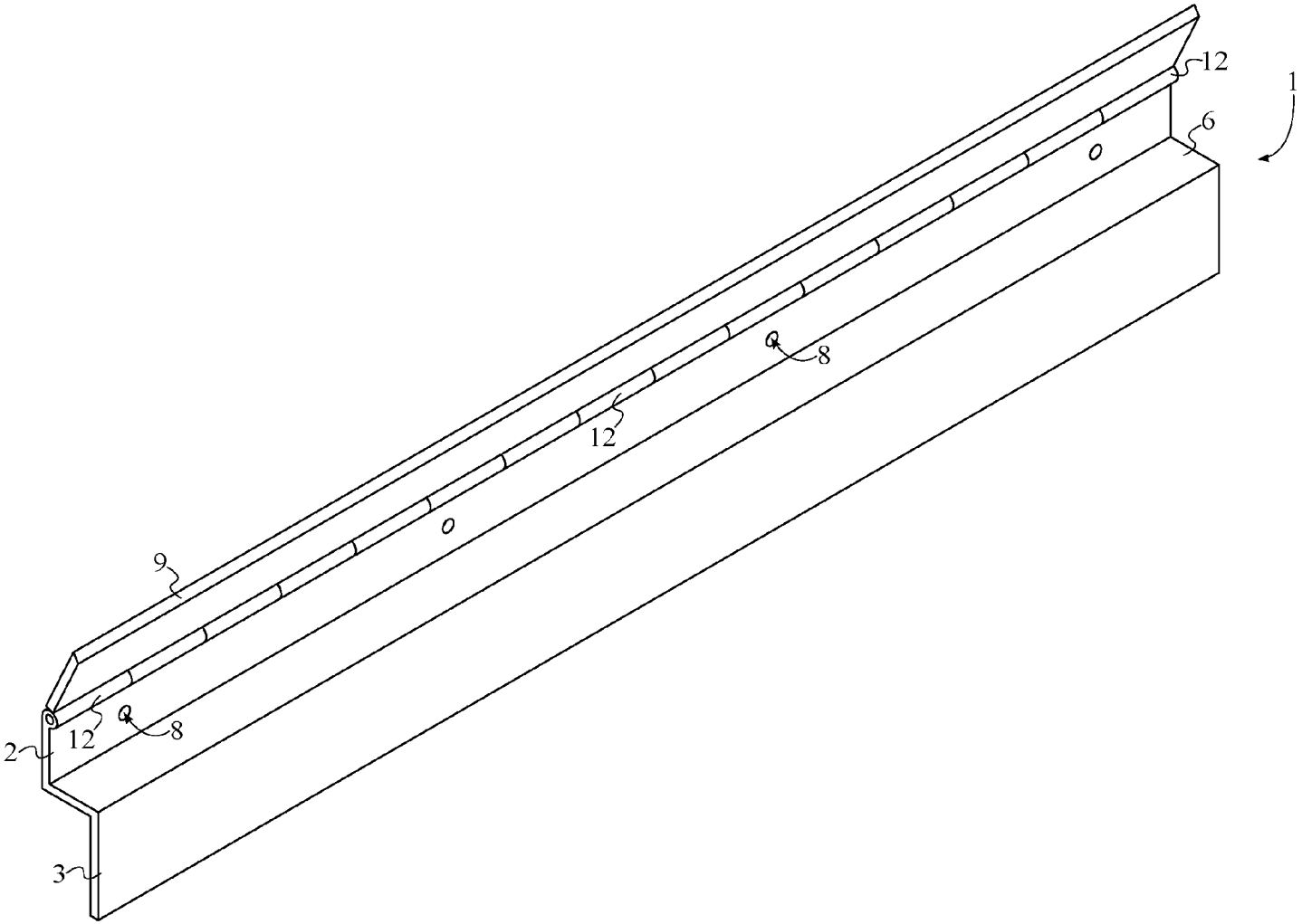
FIG. 7 is a perspective view of an embodiment of the present invention featuring a plurality of hinge knuckles.

With reference to FIG. 5 and FIG. 6, the cover plate 9 is utilized to hide any fasteners used to secure the elongated brace 1 to the surface from view once the present invention is installed on the surface, improving the aesthetic appearance of the present invention. In the preferred embodiment of the present invention, the cover plate 9 may be either removed altogether or temporarily moved to uncover the fasteners. The cover plate 9 is mounted in between the distal edge 5 of the mounting plate 2 and the proximal edge 4 of the retention plate 3, positioning the cover plate 9 to selectively cover and uncover the plurality of fastener holes 8.

In the embodiments of the present invention shown in FIGS. 1-7, the cover plate 9 is hingedly mounted to the distal edge 5 of the mounting plate 2. The hinge mechanism of the cover plate 9 enables the plurality of fastener holes 8 to be temporarily uncovered by swinging the cover plate 9 in an upward direction. The embodiment of the present invention shown in FIG. 1, FIG. 2, and FIG. 5 further comprises a first hinge knuckle 10 and a second hinge knuckle 11 that are utilized to prevent the cover plate 9 from separating from the mounting plate 2. The first hinge knuckle 10 is connected to the distal edge 5 of the mounting plate 2 while the second hinge knuckle 11 is connected to the distal edge 5 of the mounting plate 2, opposite to the first hinge knuckle 10. The first hinge knuckle 10 and the second hinge knuckle 11 are thus able to secure the two ends of the cover plate 9 to the distal edge 5 of the mounting plate 2. The cover plate 9 is engaged into the first hinge knuckle 10 and the second hinge knuckle 11 to enable the hinging movement of the cover plate 9 in this embodiment of the present invention. The embodiment of the present invention shown in FIG. 7 further comprises a plurality of hinge knuckles 12. The plurality of hinge knuckles 12 is suitable for use when mounting larger mirrors to the surface utilizing the present invention in order to more securely hold the cover plate 9 in place on the mounting plate 2. The plurality of hinge knuckles 12 is evenly distributed across the distal edge 5 of the mounting plate 2, providing multiple positions along the distal edge 5 of the mounting plate 2 for holding the cover plate 9. The cover plate 9 is engaged into the plurality of hinge knuckles 12, enabling the hinging movement of the cover plate 9.

Figure 8:
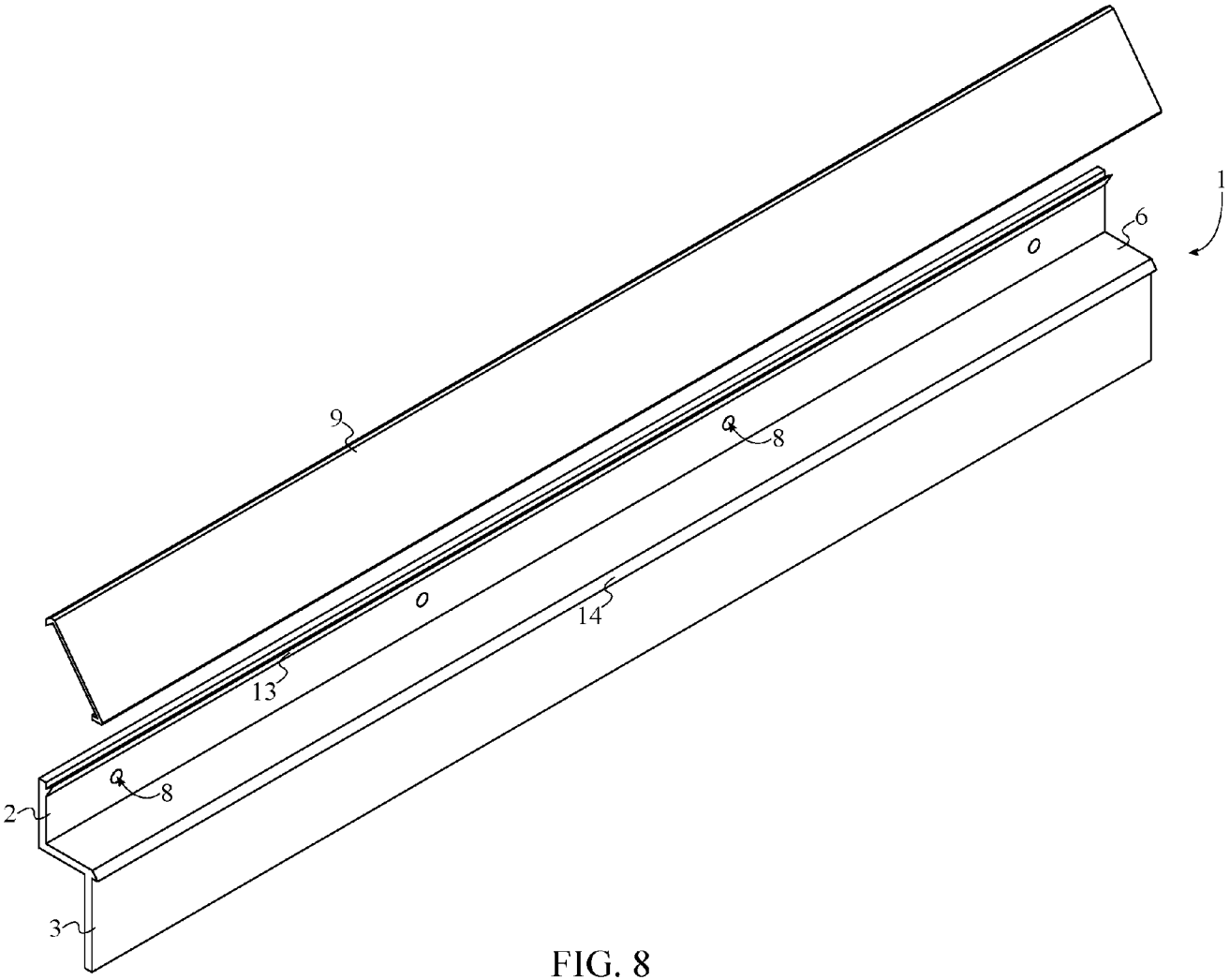
FIG. 8 is a perspective view of an embodiment of the present invention in which the cover plate is fully removable from the elongated brace.
Figure 9:
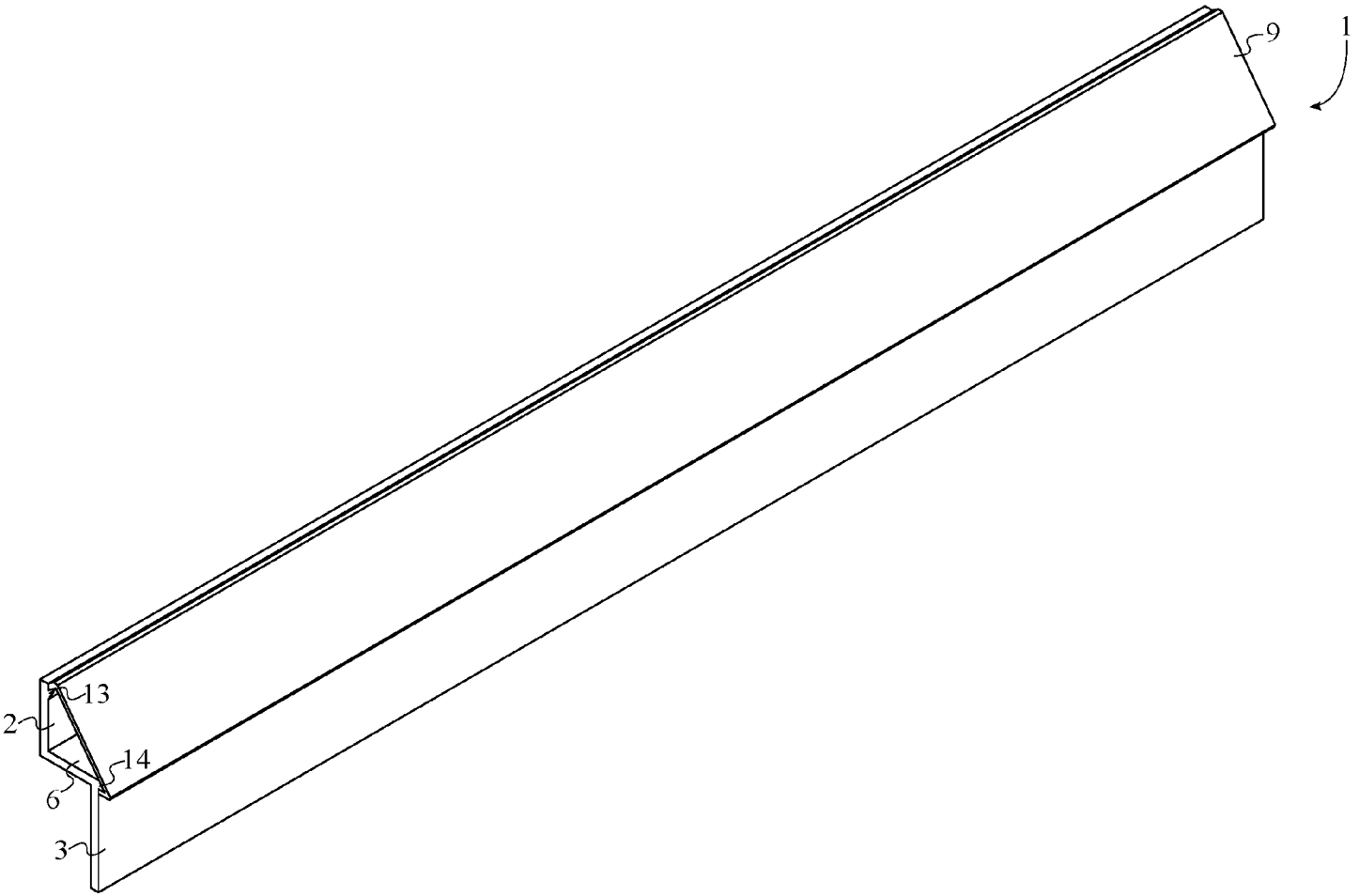
FIG. 9 is a perspective view of the embodiment of the present invention in FIG. 8 with the cover plate covering the plurality of fastener holes from view.
Figure 10:
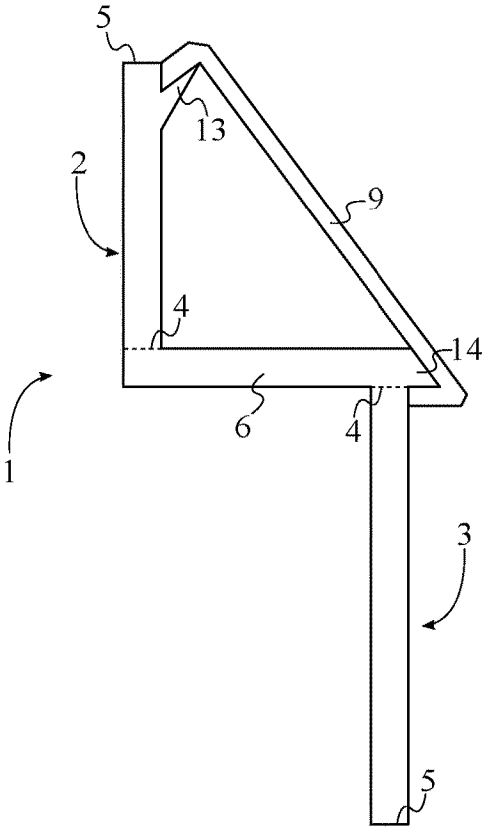
FIG. 10 is a side view of the embodiment of the present invention in FIG. 8 and FIG. 9 with the cover plate covering the plurality of fastener holes from view.

In the embodiment of the present invention shown in FIGS. 8-10, the cover plate 9 is fully removable from the elongated brace 1 in order to gain access to the plurality of fastener holes 8. This embodiment of the present invention further comprises a first retention tab 13 and a second retention tab 14 that are utilized to hold the cover plate 9 in place on the elongated brace 1 while enabling the cover plate 9 to be fully separated from the elongated brace 1. The first retention tab 13 is connected across the mounting plate 2, adjacent to the distal edge 5 of the mounting plate 2 while the second retention tab 14 is connected across the proximal edge 4 of the retention plate 3. As such, when the cover plate 9 is in place on the elongated brace 1, the cover plate 9 is positioned over the plurality of fastener holes 8 and the plurality of fastener holes 8 is hidden from view. The cover plate 9 is removably engaged to the first retention tab 13 and the second retention tab 14 to enable the cover plate 9 to be removed entirely from the elongated brace 1. When the user wishes to cover the plurality of fastener holes 8, the cover plate 9 is snapped into place on the first retention tab 13 and the second retention tab 14. This embodiment of the present invention is particularly suitable when securing a mirror very near to the ceiling of a room. The embodiments of the present invention shown in FIGS. 1-7 may be unsuitable for such applications due to the difficulty of flipping the cover plate 9 upward via the hinge in order to uncover the plurality of fastener holes 8 when the present invention is positioned close to the ceiling.

Figure 11:
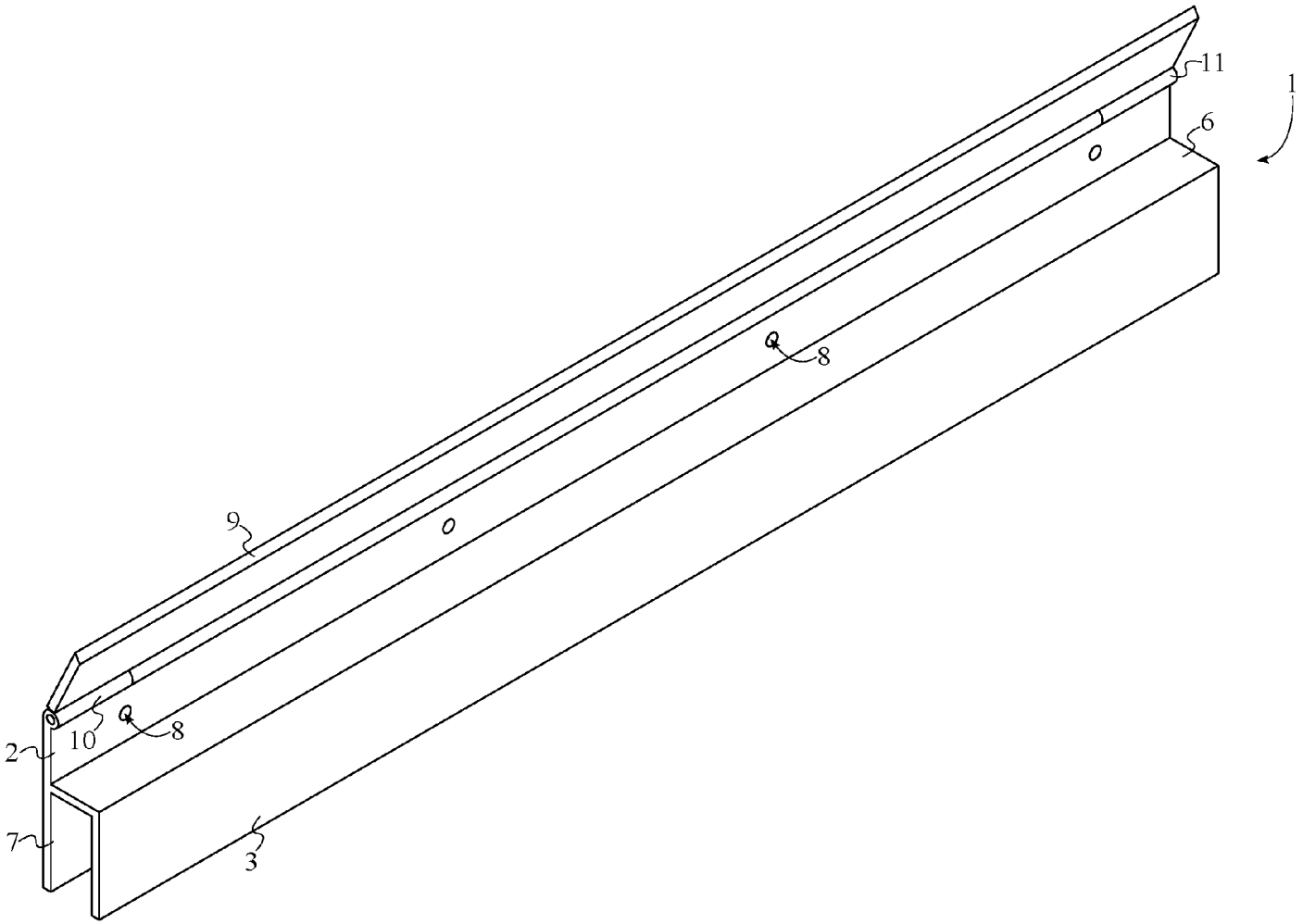
FIG. 11 is a perspective view of an embodiment of the present invention featuring the backing plate.
Figure 12:
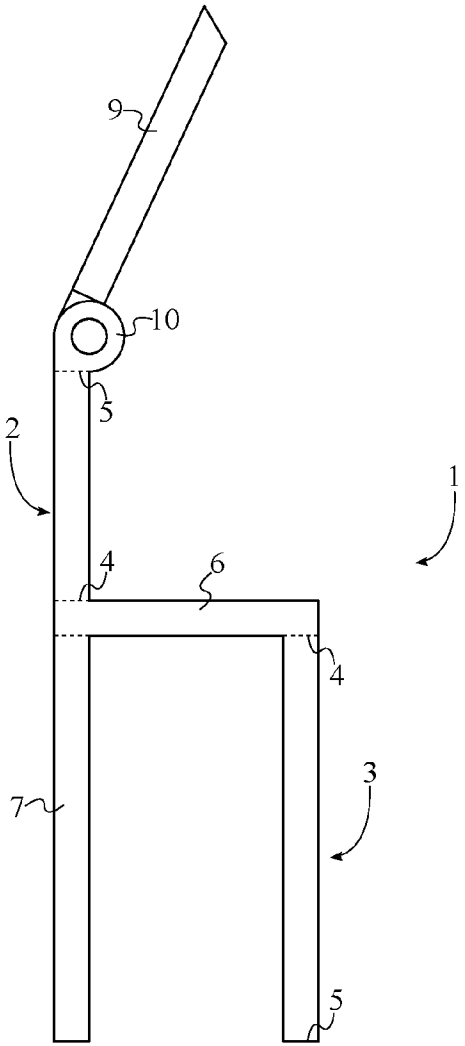
FIG. 12 is a side view of the embodiment of the present invention featuring the backing plate.

In the embodiment of the present invention shown in FIG. 11 and FIG. 12, the elongated brace 1 further comprises a backing plate 7. The backing plate 7 is an additional portion of the elongated brace 1 that, along with the retention plate 3, forms a channel into which the top edge of the mirror may be seated. The backing plate 7 is connected to the proximal edge 4 of the mounting plate 2 and is collinear to the mounting plate 2, allowing the backing plate 7 to form a channel along with the retention plate 3. The backing plate 7 enables the present invention to function similarly to a conventional J-channel in which the mirror is seated into the J-channel.

Figure 13:
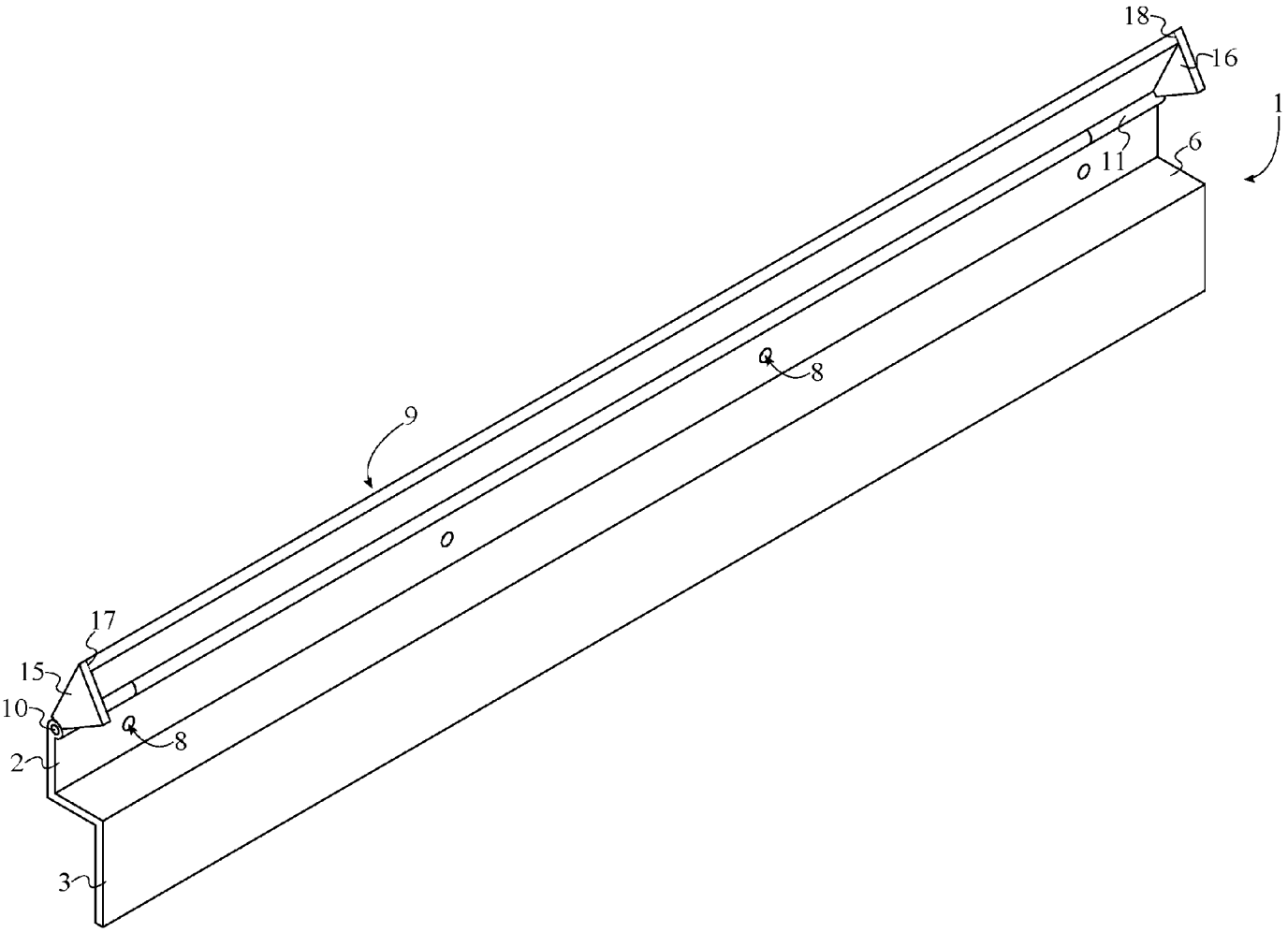
FIG. 13 is a perspective view of an embodiment of the present invention featuring a first side cover and a second side cover.
Figure 14:
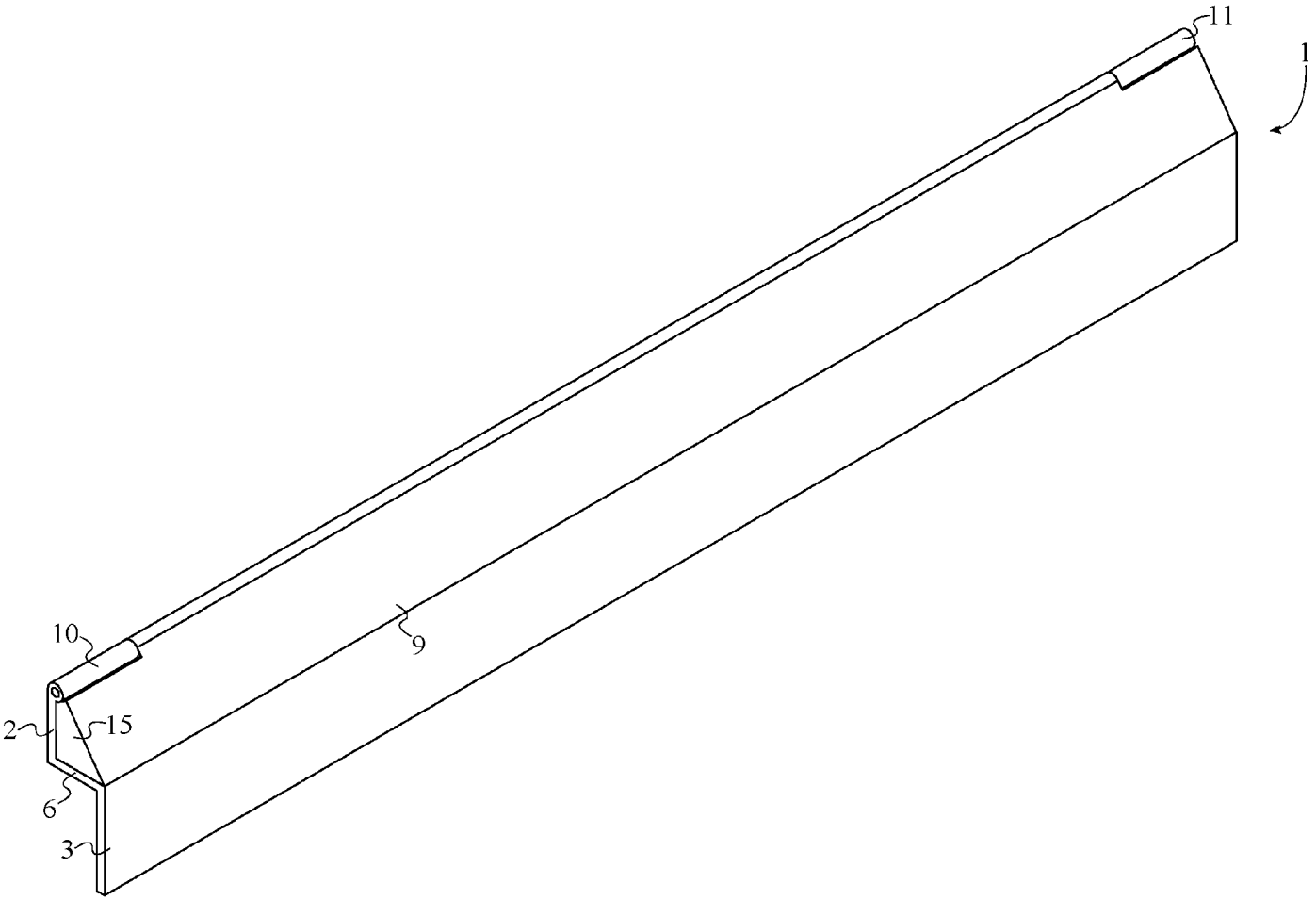
FIG. 14 is a perspective view of the embodiment of the present invention in FIG. 13 with the cover plate covering the plurality of fastener holes from view.

The embodiment of the present invention shown in FIG. 13 and FIG. 14 further comprises a first side cover 15 and a second side cover 16. The first side cover 15 and the second side cover 16 are able to more effectively hide the plurality of fastener holes 8 from view when the cover plate 9 is in place over the plurality of fastener holes 8. The first side cover 15 is connected to a first end 17 of the cover plate 9 while the second side cover 16 is connected to a second end 18 of the cover plate 9. This enables the first side cover 15 and the second side cover 16 to close the first end 17 and the second end 18 that are normally open to view.

Although the present invention has been explained in relation to its preferred embodiment, it is understood that many other possible modifications and variations can be made without departing from the spirit and scope of the present invention as hereinafter claimed.

What is claimed is:

1. A wall-mounting brace for mirrors, artwork, and similar objects comprises:
an elongated brace;
a plurality of fastener holes;
a cover plate;
the elongated brace comprises a mounting plate, a retention plate, and a connector plate;
the mounting plate and the retention plate each comprise a proximal edge and a distal edge;
the connector plate being connected adjacent and along the proximal edge of the mounting plate;
the connector plate being connected adjacent and along the proximal edge of the retention plate;
the mounting plate and the retention plate being oriented parallel to each other;
the mounting plate and the retention plate being positioned opposite to each other across the connector plate;
the distal edge of the mounting plate and the distal edge of the retention plate being oriented in opposite directions from the connector plate;
the cover plate being mounted in between the distal edge of the mounting plate and the proximal edge of the retention plate;
the plurality of fastener holes being evenly distributed across the mounting plate; and
the plurality of fastener holes traversing through the mounting plate.

2. The wall-mounting brace for mirrors, artwork, and similar objects as claimed in claim 1 further comprises:
the cover plate being hingedly mounted to the distal edge of the mounting plate.

3. The wall-mounting brace for mirrors, artwork, and similar objects as claimed in claim 2 further comprises:
a first hinge knuckle;
a second hinge knuckle;
the first hinge knuckle being connected to the distal edge of the mounting plate;
the second hinge knuckle being connected to the distal edge of the mounting plate, opposite to the first hinge knuckle; and
the cover plate being engaged into the first hinge knuckle and the second hinge knuckle.

4. The wall-mounting brace for mirrors, artwork, and similar objects as claimed in claim 2 further comprises:
a plurality of hinge knuckles;
the plurality of hinge knuckles being evenly distributed across the distal edge of the mounting plate; and
the cover plate being engaged into the plurality of hinge knuckles.

5. The wall-mounting brace for mirrors, artwork, and similar objects as claimed in claim 1 further comprises:
the proximal edge of the mounting plate being perpendicularly connected to the connector plate; and
the proximal edge of the retention plate being perpendicularly connected to the connector plate, opposite to the mounting plate.

6. The wall-mounting brace for mirrors, artwork, and similar objects as claimed in claim 1 further comprises:
a first retention tab;
a second retention tab;
the first retention tab being connected across the mounting plate, adjacent to the distal edge of the mounting plate;
the second retention tab being connected across the proximal edge of the retention plate; and
the cover plate being removably engaged to the first retention tab and the second retention tab.

7. The wall-mounting brace for mirrors, artwork, and similar objects as claimed in claim 1 further comprises:
the elongated brace further comprises a backing plate;
the backing plate being connected to the proximal edge of the mounting plate; and
the backing plate being collinear to the mounting plate.

8. The wall-mounting brace for mirrors, artwork, and similar objects as claimed in claim 1 further comprises:
a first side cover;
a second side cover;
the first side cover being connected to a first end of the cover plate; and
the second side cover being connected to a second end of the cover plate.

9. A wall-mounting brace for mirrors, artwork, and similar objects comprises:
an elongated brace;
a plurality of fastener holes;
a cover plate;
the elongated brace comprises a mounting plate, a retention plate, a connector plate, and a backing plate;
the mounting plate and the retention plate each comprise a proximal edge and a distal edge;
the connector plate being connected adjacent and along the proximal edge of the mounting plate;
the connector plate being connected adjacent and along the proximal edge of the retention plate;
the mounting plate and the retention plate being oriented parallel to each other;
the mounting plate and the retention plate being positioned opposite to each other across the connector plate;
the distal edge of the mounting plate and the distal edge of the retention plate being oriented in opposite directions from the connector plate;
the cover plate being mounted in between the distal edge of the mounting plate and the proximal edge of the retention plate;
the plurality of fastener holes being evenly distributed across the mounting plate;
the plurality of fastener holes traversing through the mounting plate;
the backing plate being connected to the proximal edge of the mounting plate; and
the backing plate being collinear to the mounting plate.

10. The wall-mounting brace for mirrors, artwork, and similar objects as claimed in claim 9 further comprises:
the cover plate being hingedly mounted to the distal edge of the mounting plate.

11. The wall-mounting brace for mirrors, artwork, and similar objects as claimed in claim 10 further comprises:
a first hinge knuckle;
a second hinge knuckle;
the first hinge knuckle being connected to the distal edge of the mounting plate;
the second hinge knuckle being connected to the distal edge of the mounting plate, opposite to the first hinge knuckle; and the cover plate being engaged into the first hinge knuckle and the second hinge knuckle.

12. The wall-mounting brace for mirrors, artwork, and similar objects as claimed in claim 10 further comprises:

a plurality of hinge knuckles;

the plurality of hinge knuckles being evenly distributed across the distal edge of the mounting plate; and the cover plate being engaged into the plurality of hinge knuckles.

13. The wall-mounting brace for mirrors, artwork, and similar objects as claimed in claim 9 further comprises:

the proximal edge of the mounting plate being perpendicularly connected to the connector plate; and the proximal edge of the retention plate being perpendicularly connected to the connector plate, opposite to the mounting plate.

14. The wall-mounting brace for mirrors, artwork, and similar objects as claimed in claim 9 further comprises:

a first retention tab;

a second retention tab;

the first retention tab being connected across the mounting plate, adjacent to the distal edge of the mounting plate;

the second retention tab being connected across the proximal edge of the retention plate; and the cover plate being removably engaged to the first retention tab and the second retention tab.

15. The wall-mounting brace for mirrors, artwork, and similar objects as claimed in claim 9 further comprises:

a first side cover;

a second side cover;

the first side cover being connected to a first end of the cover plate; and the second side cover being connected to a second end of the cover plate.

* * * * *